US006845219B2

(12) United States Patent
Yamamuro et al.

(10) Patent No.: US 6,845,219 B2
(45) Date of Patent: Jan. 18, 2005

(54) IMAGE FORMING APPARATUS CAPABLE OF VERIFYING THE AVAILABILITY OF DESIRED IMAGE DEVELOPING UNITS

(75) Inventors: Takashi Yamamuro, Ebina (JP); Kunio Yamada, Ebina (JP); Makoto Hirota, Ebina (JP); Yoshinori Matsuno, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/372,781

(22) Filed: Feb. 26, 2003

(65) Prior Publication Data

US 2004/0037574 A1 Feb. 26, 2004

(30) Foreign Application Priority Data

Aug. 20, 2002 (JP) ..... 2002-239849

(51) Int. Cl.[7] ..... G03G 15/00
(52) U.S. Cl. ..... 399/13
(58) Field of Search ..... 399/13, 54, 112

(56) References Cited

U.S. PATENT DOCUMENTS 5,760,928 A * 6/1998 Motoyama et al.
2003/0053117 A1 * 3/2003 Payne et al. ..... 399/54

FOREIGN PATENT DOCUMENTS

JP A 2000-131875 5/2000
JP A 2001-194846 7/2001

* cited by examiner

*Primary Examiner*—Arthur T. Grimley
*Assistant Examiner*—Ryan Gleitz
(74) *Attorney, Agent, or Firm*—Oliff & Berridge PLC

(57) ABSTRACT

An image forming apparatus includes an image carrier and a first developing unit for forming an image on the image carrier using at least one type of first developer to which a second developing unit for forming an image using at least one type of second developer which differs from the first developer is installable. The apparatus includes a developing unit determination part for determining the type of developing unit of the image forming apparatus, and an announcement part for announcing to the user that, when the second developing unit is not installed and an image formation instruction for instructing the formation of an image obtained by using the second developer is inputted, the image formation instruction cannot be made to effect a response.

41 Claims, 10 Drawing Sheets

IMAGE FORMING APPARATUS CAPABLE OF VERIFYING THE AVAILABILITY OF DESIRED IMAGE DEVELOPING UNITS

BACKGROUND OF THE INVENTION

1. Field of the Invention

The present invention relates to an image forming apparatus wherein an electronic photography system is used, such as a copier, a printer, a facsimile and a machine wherein these are combined, and, in particular, to an image forming apparatus that can obtain the reproduction of an image by using a specific developing material in addition to the reproduction of an image by using a common developing material.

2. Description of the Related Art

Conventional image forming apparatuses such as a copier, a printer and the like wherein an electronic photography system or an electro static transfer system are utilized is widely known. In such image forming apparatuses, normally a monochromatic image obtained by means of a black toner, a full color image obtained by means of color toners of yellow, cyan and magenta, respectively, or the like, are formed on a sheet of paper which is then outputted. In addition to these conventional (two-dimensional) images, a technology for obtaining a three-dimensional image using a specific toner (foaming toner) has been proposed. The present applicant has previously proposed, for example, "Image Formation Toner, Manufacturing Method for the Same and Method for Forming Three-Dimensional Images Using the Same as well as Image forming apparatus" and "Image forming apparatus" in Japanese Unexamined Patent Publication No. 2000-131875, in Japanese Unexamined Patent Publication No. 2001-194846, and the like. Furthermore, a conventional technology for obtaining an image of metallic colors, such as of gold or of silver, by using specific toners (metallic color toners) has been proposed.

However, it is not appropriate for all image forming apparatuses to be provided with the function of being able to form images using specific toners (foaming toners or metallic color toners) because it forces the user who does not need an image obtained by means of specific toners to pay additional costs for additional functions. On the other hand, it is in efficient to separately manufacture image forming apparatuses that solely use conventional toners and image forming apparatuses that use specific toners as well as conventional toners. Therefore, image forming apparatuses that solely use conventional toners are equipped, as an option, with a developing unit and an image forming unit that use specific toners and, thereby, it is considered that image forming apparatuses that meet the needs of the user can be efficiently provided.

On the other hand, in some cases, wherein an image forming apparatus is formed so that a developing unit and an image forming unit can be equipped (in a replaceable manner or in an additive manner) with the image forming apparatus in the above described manner, the user may mistakenly instruct the formation of an image that corresponds to a developing unit, or the like, that is not installed. In such a case, if an announcement is not made, the user cannot recognize that the corresponding developing unit, or the like, is not installed.

SUMMARY OF THE INVENTION

The present invention has been made in view of such a problem and an object of the invention is to provide an image forming apparatus wherein a developing unit is installed (in a replaceable manner or in an additive manner) so that a user can recognize that this developing unit is not installed in the case where the user mistakenly instructs the formation of an image corresponding to a developing unit that is not installed.

To achieve the above object, according to the present invention, there is provided an image forming apparatus with an image carrier and a first developing unit for forming an image using at least one type of first developer wherein a second developing unit for forming an image using at least one type of second developer of this image carrier that differs from this first developer and wherein an announcement part that announces to the user, when a developing unit determination part for determining the type of developing unit provided to this image forming apparatus and the above second developing unit are not installed, and an image formation instruction for instructing an image obtained by using the second developer is inputted, that image formation instruction cannot be made to effect a response. Here, the above described second developing unit may be (alternately) installable in place of the entirety of, a portion of, the above described first developing unit or may be additionally installable.

In addition, developing units maybe individually installed to the image forming apparatus or may collectively be installed to the image forming apparatus as a plurality. Furthermore, the developing unit alone may be installed to the image forming apparatus or may be installed to the image forming apparatus as an image forming unit that includes an image carrier in addition to the developing unit.

In addition, the present invention can adopt the following configuration in the case where the above described second developing unit is installed in place of the entirety, or a portion of, the above described first developing unit (in an alternative manner). That is to say, the image forming apparatus may be provided with an image carrier and a first developing unit for forming an image obtained by using at least one type of first developer with respect to the image carrier and a second developing unit for forming an image obtained by using at least one type of second developer that differs from the first developers is installable to the image carrier, wherein the second developing unit is installed in place of the entirety of, or a portion of, the above described first developing unit and a developing unit determination part for determining the type of developing unit provided to the image forming apparatus as well as an announcement part for announcing a message to the user that, in the case where an image formation instruction is inputted for instructing the formation of an image obtained by using the first developer of the first developing unit that has been replaced, the image formation instruction cannot be made to effect a response.

The configuration of the announcement part can, for example, be cited as follows.

First, an announcement part can be cited wherein the announcement part is provided with a display panel so that in the case where an image formation instruction is inputted for instructing the formation of an image obtained by using a developer of a developing unit that is not installed, the announcement part displays a message that the image formation instruction cannot be carried out (without a change) on the display panel.

Second, an announcement part can be cited wherein, in the case where an image formation instruction is inputted for instructing the formation of an image obtained by using a developer of a developing unit that is not installed, the announcement part prints out a message that the image formation instruction cannot be carried out (without a change) (on a recording medium).

Third, an announcement part can be cited wherein the announcement part comprises a storage part for storing e-mail addresses corresponding to respective users, an inputted image formation instruction includes user information for specifying the user that has issued this image formation instruction and, in the case where an image formation instruction is inputted for instructing the formation of an image obtained by using a developer of a developing unit that is not installed, the announcement part transmits e-mail to the user to the effect that the image formation instruction cannot be carried out (without a change) based on user information and the e-mail address.

In addition, in the case where an image formation instruction is inputted for instructing the formation of an image obtained by using a developer of a developing unit that is not installed, a control part for carrying out the following processes, respectively, may be provided.

First, an image forming apparatus can be cited that is provided with a control part wherein, in the case where an image formation instruction is inputted for instructing the formation of an image obtained by using a developer of a developing unit that is not installed, the control part cancels the image formation instruction.

Second, an image forming apparatus can be cited that is provided with a control part wherein, in the case where an image formation instruction is inputted for instructing the formation of an image obtained by using a developer of a developing unit that is not installed, the control part holds the image formation instruction and the image formation instruction that has been held is carried out after the developing unit is installed.

Third, an image forming apparatus can be cited that is provided with a control part wherein, in the case where an image formation instruction is inputted for instructing the formation of an image obtained by using a developer of a developing unit that is not installed, the control part carries out the image formation instruction in an alternative manner and in a pseudo manner by utilizing an installed developing unit.

Furthermore, as for the control part that "carries out the image formation instruction in an alternative manner" in the third process, for example, the above described control part utilizes the installed developing apparatus so as to form the image according to a portion of the image formation instruction for instructing the formation of the image obtained by using a developer of a developing unit that has been installed and utilizes the installed developing unit so as to form the image according to a portion of the image formation instruction for instructing the formation of the image obtained by using a developer of a developing unit that is not installed. More concretely, the above described installed developing unit has three types of developers, of yellow, magenta and cyan, the above described developing unit that is not installed has a black developer and the above described control part utilizes three developing units, of yellow, magenta and cyan, (in an alternative manner according to a so-called process black) so as to form the image according to the portion of the image formation instruction for instructing the formation of an image obtained by using the black developer.

In addition, as for another example of the control part that "carries out the image formation instruction in a pseudo manner" in the third process, the above described control part utilizes the installed developing apparatus so as to form the image according to a portion of the image formation instruction for instructing the formation of the image obtained by using a developer of a developing unit that has been installed and utilizes the installed developing unit so as to form an alternate image that differs from the image according to a portion of the image formation instruction for instructing the formation of the image obtained by using a developer of a developing unit that is not installed. More concretely, a specific mark (specific symbol such as an asterisk) can be used as the above described alternative image.

In addition, the control part may make the following report to the user at the time when these processes are carried out by the control part. For example, the above described announcement part can report to the user a message that the image formation instruction cannot be carried out without a change as well as the processing method of the image formation instruction (cancellation of the image formation instruction as the first process, holding and subsequent implementation of the image formation instruction as the second process and alternative implementation of the image formation instruction as the third process). In addition, the above described announcement part can report to the user a message that the image formation instruction cannot be carried out without a change as well as the task necessary for carrying out the image formation instruction (addition of a developing unit, an image forming unit or an option unit or replenishment of developer when the developer is in short supply).

In addition, the first developer and the second developer can be distinguished from each other when the first developer does not include a foaming agent while the second developer does include a foaming agent, when the first developer includes a coloring agent of a non-metallic color while the second developer includes a coloring agent of a metallic color, when the first developer includes a specific coloring agent (for example, of a non-fluorescent color) while the second developer includes a coloring agent (for example, of a fluorescent color) differing from this specific coloring agent, or when the first developer includes a coloring agent while the second developer does not include a coloring agent (for example, of a transparent coating material).

(One type of) developer, which includes a black coloring agent, three types of developers, which include coloring agents of yellow, magenta and cyan, respectively, and four types of developers, which include a black coloring agent in addition to these three types of developers, can, for example, be cited as the first developer. In addition, a colorless (one type of) developer, which includes a foaming agent and does not include a coloring agent, (one type of) developer that includes a foaming agent and a coloring agent, (one type of) developer that does not include a foaming agent and that does include a coloring agent of a metallic color or a plurality of types of developers resulting from an arbitrary combination of the above can be cited as a the second developer. Here, the foaming agents and the coloring agents may be internally added to the developers or may be externally added to the developers.

In addition, in order to determine the type of installed developing unit, the developing unit may be of a specific form in accordance with the developer thereof so that the developing unit determination part is provided wherein the type of installed developing unit is determined based on this specific form or the developing unit may be provided with a non-volatile memory and developer information indicating the developer thereof is stored in this non-volatile memory so that the developing unit determination part is provided wherein the type of installed developing unit is determined based on the read out developer information. Furthermore, in the case where an image forming unit that includes an image carrier in addition to the developing unit is installed to the image forming apparatus, this image forming unit may be in a specific form in accordance with the developer or the image forming unit may be provided with a non-volatile memory.

In addition, a (layer) control part is provided for controlling a layer of the image on a recording medium based on the determination result of the developing unit determination part. As for the control carried out by the (layer) control part, in the case where the above described installed second developing unit is utilized, the image forming apparatus can be controlled so that the image obtained by using the above described second developer becomes a specific layer in the layers of the image on the recording medium. Here, the specific layer maybe ① automatically determined by the image forming apparatus (without the intervention of user operation) or may be ② determined based on an instruction by the user.

That is to say, in the case of the former ①, the above described specific layer is automatically determined in accordance with the type of the above described second developing unit that is utilized. In the case wherein, for example, the above described first developer does not include a foaming agent while the above described second developer does include a foaming agent, it is automatically determined that the above described specific layer is the lowest layer of the layers of the image on the recording medium. In addition, in the case wherein, for example, the above described first developer includes a coloring agent of a non-metallic color while the above described second developer includes a coloring agent of a metallic color, it is automatically determined that the above described specific layer is the uppermost layer of the layers of the image on the recording medium.

In addition, in the case of the latter ②, a user interface part for inputting an indication by the user is provided so that the above described specific layer is determined based on an instruction from this user interface part. An operation button, an operation panel, and the like, of the image forming apparatus can be cited as this user interface part. In another case wherein the specific layer is determined by an instruction by the user, an instruction by the user is transmitted via a computer (including a printer driver) connected to a printer (image forming apparatus).

As for a method for controlling a layer of the image on the recording medium, cases can be cited wherein the (layer) control part controls the order of formation of the image on the image carrier by the respective developing units and, thereby, the layer of the image on the recording medium is controlled or wherein a transfer part controls the order of the transfer of the image (onto an intermediate transfer body or onto the recording medium) and, thereby, the layer of the image is controlled.

In addition, in the case where the above described second developing unit that has been installed is utilized, according to the second control carried out by the (layer) control part, the image can be layered on the recording medium by using the above described second developer based on an electronic photographic parameter (for example, one, or more, from among the developing bias, the electrification bias (surface potential of the image carrier), the transfer bias, the fixing temperature, the fixing ratio and the image process) differing from those at the time when the images is layered on the recording medium by using the above described first developer. Here, the above described electronic photographic process parameters may be automatically determined in accordance with the type of the above described second developing unit that is utilized.

In addition, the transfer part for transcribing the image formed on the image carrier onto the recording medium may be formed solely of a final transfer part wherein the image on the image carrier is directly transferred onto the recording medium or an intermediate transfer body and an intermediate transfer part may be provided with the final transfer part wherein the image on the image carrier is once transferred onto the intermediate transfer body by means of the intermediate transfer part and, then, the image on the intermediate transfer body is transferred onto the recording medium by means of the final transfer part.

In addition, the present invention can be applied to an image forming apparatus of any electronic photography system. Focusing on the relationship between the developing unit and the image carrier (photosensitive body or latent image carrier), a one-to-one relationship between the respective developing units and the image carriers as well as an N (N: natural number) to one relationship can be cited. As for an example of the former, a monochromatic image forming apparatus, a full color image forming apparatus of a tandem system wherein intermediate transfer bodies are used so that image forming units for the respective colors of intermediate transfer bodies are aligned from the upstream side to the downstream side of the intermediate transfer bodies, or the like, can be cited while, as for an example of the latter, an image forming apparatus using a developing apparatus of a rotary system, a full color image forming apparatus wherein developing units for the respective colors of the image carriers are aligned from the upstream side to the downstream side of the image carriers, or the like, can be cited.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of the embodiments of the present invention with reference to the drawings.

(Embodiment 1)

Figure 1:
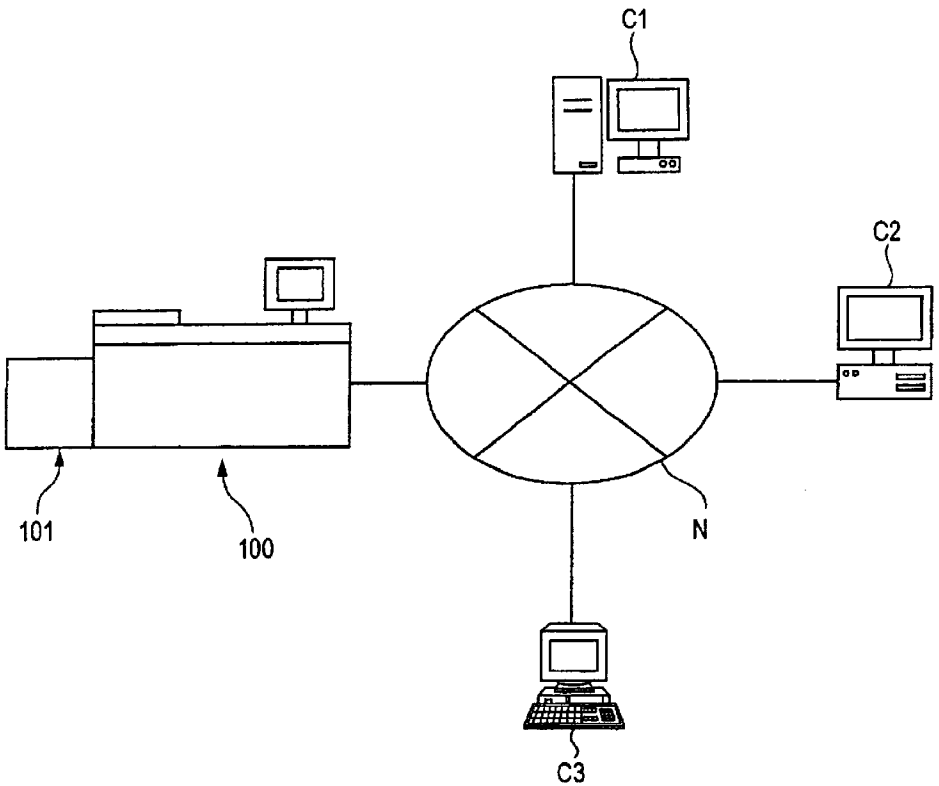
FIG. 1 is a schematic diagram showing an example of an image formation system according to Embodiments 1 through 3 of the present invention.

In accordance with FIG. 1, the utilization condition of a color copier 100 using an electronic photography system as an image forming apparatus according to Embodiment 1 of this invention is described. A paper supply apparatus 101 that allows the containment of a large amount of recording paper P is provided to this color copier 100. In addition, color copier 100 is connected to a plurality (here, three) of personal computers C1 to C3 via a local area network N.

Each computer C1 to C3 is provided with hardware configuration made of a central processing unit, a control apparatus, a random access memory, a hard disk, a display, an input/output apparatus including a communications control apparatus, and the like, and with software configuration made of basic software, application software, and the like, so as to implement a variety of functions. Word processing software and drawing software are, for example, provided as application software so that it is possible to make copier 100 output prepared sentences and drawings via network N. In addition, electronic mail software is provided as application software so that it is possible to transmit and receive e-mails between respective computers C1 to C3 connected to network N.

Figure 2:
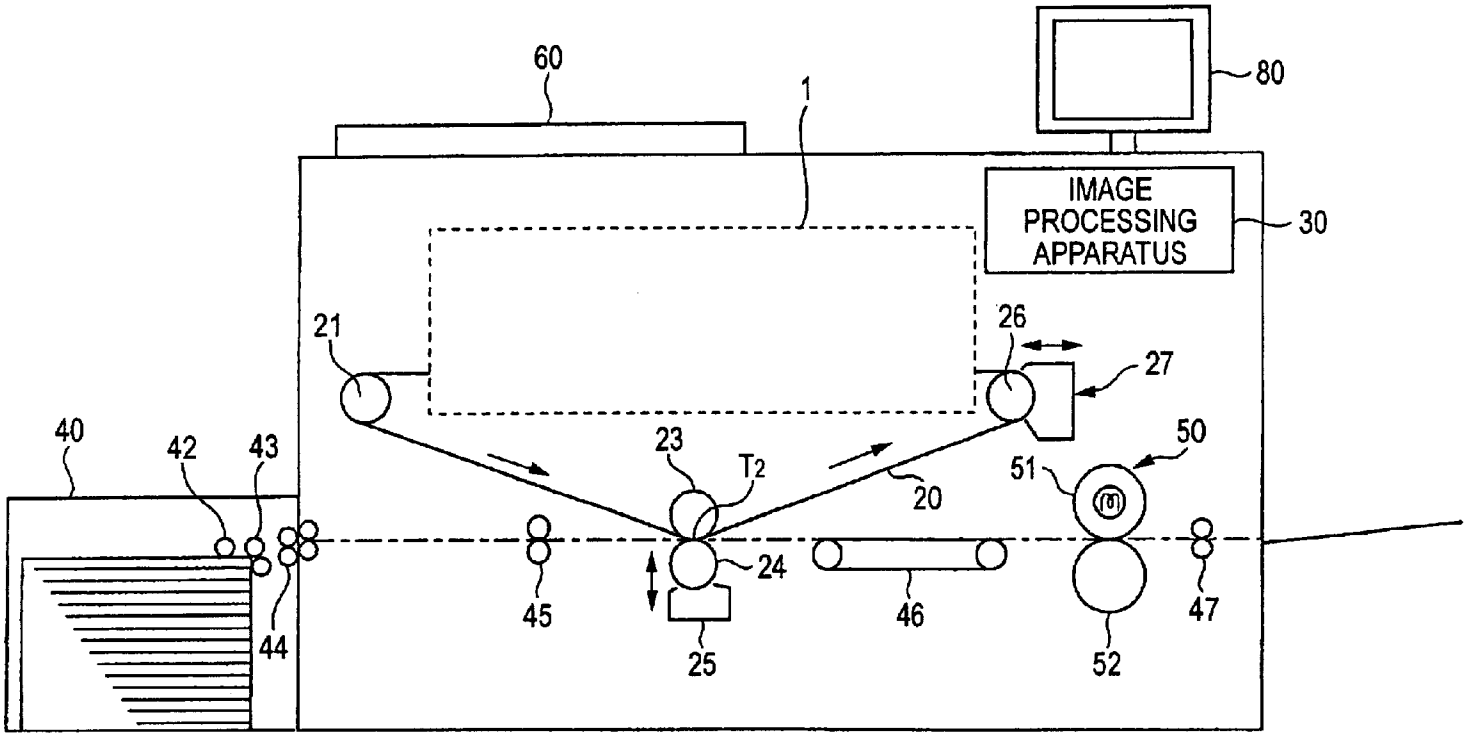
FIG. 2 is a cross sectional schematic view showing an example of a color copier according to Embodiments 1 through 3 of the present invention.
Figure 3A:
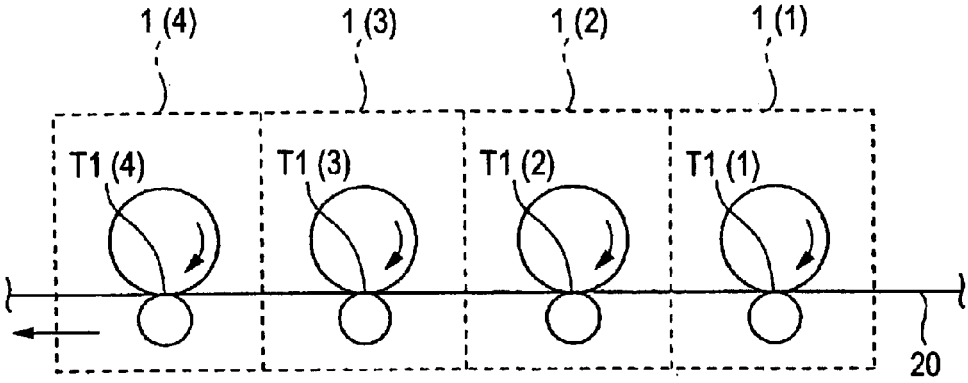
FIGS. 3A and 3B are cross sectional views showing an image formation part of the color copier of FIG. 2.

A cross sectional schematic view of color copier 100 and paper supply apparatus 101 is described according to FIG. 2. In addition, an image formation part 1 of copier 100 is described in further detail according to FIG. 3A and one type of image forming unit 1(*i*) (i: 1 to 4) that forms image formation part 1 of FIG. 3A is described in detail according to FIG. 3B.

A document read-out apparatus 60 for reading out the image of a document d covered by a platen cover is provided on the top of this color copier 100. In this document read-out apparatus, document d placed on a platen glass is illuminated by means of a light source and the image of the reflected light from document d is scanned and exposed on an image read-out element made of a CCD, or the like, via a scale down optical system made of a full rate mirror, a half rate mirror and a condensing lens so that the image of reflected light from colored materials of document d is read out according to a predetermined dot density (for example, 16 dots per mm) by means of this image read-out element.

The image of reflected light from colored materials of document d that has been read out by the above described document read-out apparatus 60 is sent to an image processing apparatus 30 as document reflectance data of three colors of, for example, red (R), green (G) and blue (B), (eight bits each), and predetermined image processes such as shading correction, position shift correction, brightness/color space conversion, gamma correction, frame cancellation or color/shift editing are carried out on the reflectance data of document d in this image processing apparatus 30.

In addition, a liquid crystal touch-type panel 80 is provided on the top of this copier 100 as a user interface. The operation procedures or a message to the user is outputted to this liquid crystal panel 80 wherein the user touches a predetermined region with a finger and, thereby, an operation instruction is inputted.

Image formation part 1 that allows the formation of a plurality of toner images having different colors is provided inside the above described color printer 100 and in the main body of copier 100. First image forming unit 1(1) to fourth image forming unit 1(4) are provided from the upstream side to the downstream side of an intermediate transfer belt 20 in the direction of rotation and image forming units 1(1) to 1(4), respectively, are provided so as to form an image by using developers of different types. Here, first image forming unit 1(1) to fourth image forming unit 1(4) are image forming units corresponding to yellow, magenta, cyan and black, respectively.

Figure 3B:
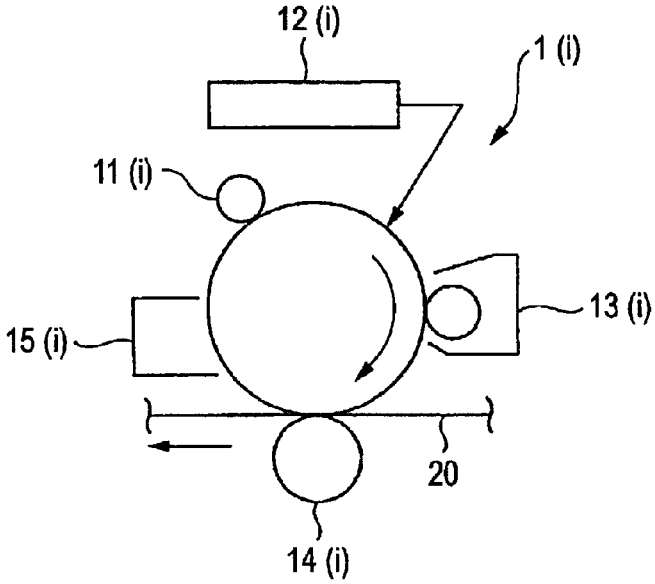

In addition, each image forming unit 1 is formed around a photosensitive drum (image carrier) 10 as the center, as shown in FIG. 3B, and an electrification roll 11, an ROS (Raster Output Scanner) 12, a developing machine (developing unit) 13, a primary transfer role 14 and a photosensitive cleaning apparatus 15 are provided around the photosensitive drum. In addition, image data wherein predetermined image processes have been carried out by means of image processing apparatus 30, as described above, is sent to respective ROSs 12(1) to 12(4) as gradation data of four colors, yellow (Y), magenta (M), cyan (C) and black (BK), (eight bits each), and image exposure is carried out by means of a laser beam in accordance with the gradation data in these ROSs 12(1) to 12(4).

The above described ROSs 12 modulate a semiconductor laser, not shown, in accordance with the gradation data so that a laser beam LB is emitted from this semiconductor laser in accordance with the gradation data, and photosensitive drum 10 is scanned and exposed. This photosensitive drum 10 is driven so as to rotate at a predetermined rate of speed in the direction of the arrow in FIGS. 3A and 3B by means of a driving part, not shown. The surface of this photosensitive drum 10 is charged to a predetermined polarity (for example, minus polarity) and potential in advance by means of electrification roll 11 and, after that, an electrostatic latent image is formed as a result of scanning and exposure with laser beam LB in accordance with document reproduction color material gradation data. The surface of the above described photosensitive drum 10 is uniformly charged to, for example, −650V and, after that, the image portion is scanned and exposed with laser beam LB so that an electro static latent image where in the exposed portion becomes of −200V is formed.

The electrostatic latent images formed on the above described photosensitive drum 10 are developed reversely with toners (first developers) charged so as to have a minus polarity that is the same polarity as the polarity of the charged photosensitive drum 10 in a developing region by means of respective developing machines (first developing units) 13Y to 13BK corresponding to yellow (Y), magenta (M), cyan (C) and black (BK) so as to be toner images T of predetermined colors. At this time, a developing bias voltage of, for example, −500V is applied to the developing rolls of the above described respective developing machines 13Y to 13BK.

Toner images with toners (first developers) of the respective colors formed on the above described photosensitive drum 10 are transferred in a multiple manner on intermediate transfer belt 20 as an intermediate transfer body placed in the lower portion of this photosensitive drum 10 at nipping parts T1 by means of primary transfer rolls 14. That is to say, first, the yellow toner image is primarily transferred on intermediate transfer belt 20 from first image forming unit 1(1) at nipping part T1(1) and, in the same manner, magenta, cyan and black toner images, respectively, are primarily transferred in sequence onto intermediate transfer belt 20 from second to fourth image forming units 1(2) to 1(4) at nipping parts T1(2) to T1(4).

This intermediate transfer belt 20 is tensioned, as shown in FIG. 2, through drive roll 21, follow roll 26, tension roll 22 and backup roll 23 as an opposing roll forming a portion of a secondary transfer part and is supported so as to be rotatable in the direction of the arrow at the same speed of shift as the circumferential speed of photosensitive drum 10. Toner images transferred onto this intermediate transfer belt 20 are transferred to a sheet of recording paper P as a recording medium conveyed to secondary transfer position T2 according to a predetermined timing by means of a pressing force and an electrostatic attraction force of backup roll 23, which supports intermediate transfer belt 20, and of secondary transfer roll 24 that forms a portion of the second transfer part, which press against this backup roll 23.

As for the above described recording paper (recording medium) P, sheets of paper of a predetermined size supported by a paper guide are supplied, as shown in FIG. 2, from paper supply apparatus 40 attached to copier 100 by means of pickup roll 42, a feed roll and retard roll 43. Recording paper P that has been supplied is conveyed to secondary transfer position T2 of intermediate transfer belt 20 according to a predetermined timing by means of a plurality of conveyance rolls 44 and resist roll 45. Then, toner images of predetermined colors are collectively transferred from intermediate transfer belt 20 onto the above described recording paper P by means of backup roll 23, as the secondary transfer part, and by means of secondary transfer roll 24 as described above.

In addition, recording paper P, onto which the toner images of the predetermined colors are transferred from the above described intermediate transfer belt 20, is separated from intermediate transfer belt 20 and, after that, is conveyed to a fixing apparatus 50 wherein the toner images are fixed on recording paper P by means of heating and pressure from heat roll 51 and pressure roll 52 of this fixing apparatus 50 and, thereby, recording paper P is discharged to the outside of color printer 100 and the body of copier 102 by means of discharge roll 46 so as to complete the formation process of a color image.

Here, an intermediate transfer belt cleaner for cleaning intermediate transfer belt 20 is denoted as 27 and a cleaner for cleaning secondary transfer roll 24 is denoted as 25, respectively, in FIG. 2. In addition, intermediate transfer belt cleaner 27 and cleaner 25 for secondary transfer roll 24 are formulated so as to make contact with, and so as to separate from, intermediate transfer belt 20 according to a predetermined timing.

In addition, it is possible for color copier 100 according to this Embodiment 1 to be equipped with respective developing machines (first developing units) 13Y to 13BK having the respective toners (first developers that do not include a foaming agent) of yellow Y, cyan C, magenta M and black BK and a developing machine (second developing unit) 73E having foaming toner E (second developer that includes a foaming agent). Here, the below described foaming toner E expands in volume due to heating when it is heated by fixing apparatus 50 and, thereby, allows the formation of a three-dimensional image on recording paper P.

Figure 4:
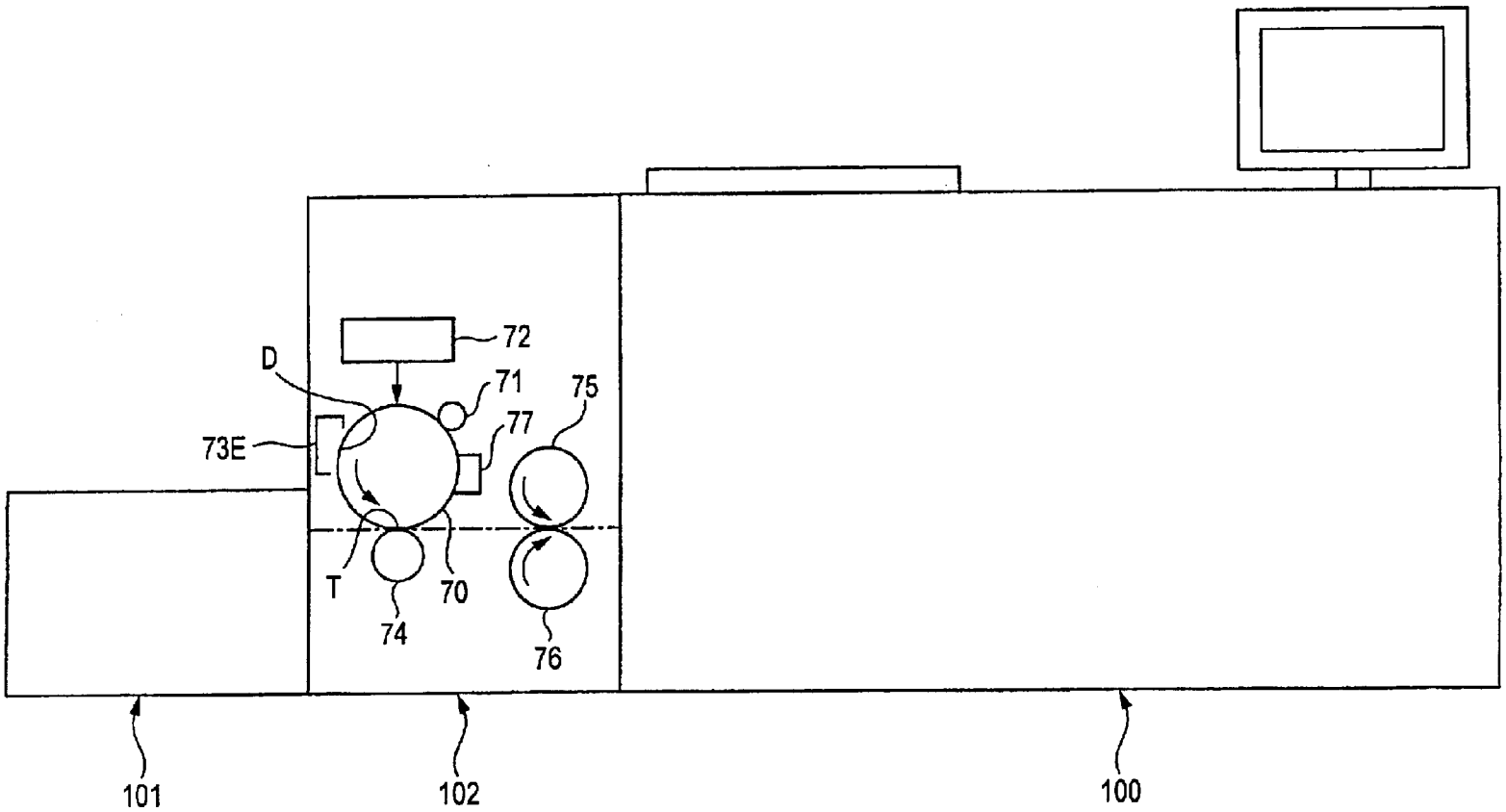
FIG. 4 is a diagram showing the color copier of FIG. 2 to which an optional apparatus is attached.

FIG. 4 shows color copier 100 to which a foaming image forming apparatus 102 is attached as an optional apparatus. This foaming image forming apparatus 102 is provided with a photosensitive drum 70 and with a primary electrification roll 71, an ROS 72, a developing machine 73, a primary transfer roll 74, a heating roll 75 and a pressing roll 76 as a pre-fixing apparatus and a photosensitive body cleaning apparatus 77 around the photosensitive drum. Thus, the image of foaming toner E is primarily transferred onto recording paper P according to the above described electronic photography process and is temporarily fixed in the pre-fixing apparatus and, then, the images of the respective color toners, of yellow Y, cyan C, magenta M and black BK, are, further, primarily transferred onto the recording paper in color copier 100 and are (permanently) fixed in fixing apparatus 50.

Here, the glass transfer temperature of foaming toner E is set at a temperature lower than the foaming commencement temperature and it is preferable for the temporary fixing temperature to be higher than the glass transfer temperature of foaming toner E and to be lower than the foaming commencement temperature. In addition, it is preferable for the temporary fixing temperature to be a temperature wherein foaming toner E foams slightly.

In addition, it is possible for color copier 100 according to the present embodiment to be equipped with foaming image forming apparatus 102 in the above described manner and a case is considered where foaming image formation is instructed in the condition when foaming image forming apparatus 102 is not attached. In order to prepare for such a case, color copier 100 according to the present embodiment is equipped with the following control apparatus (developing unit determination part, announcement part, control part) 90.

Figure 5:
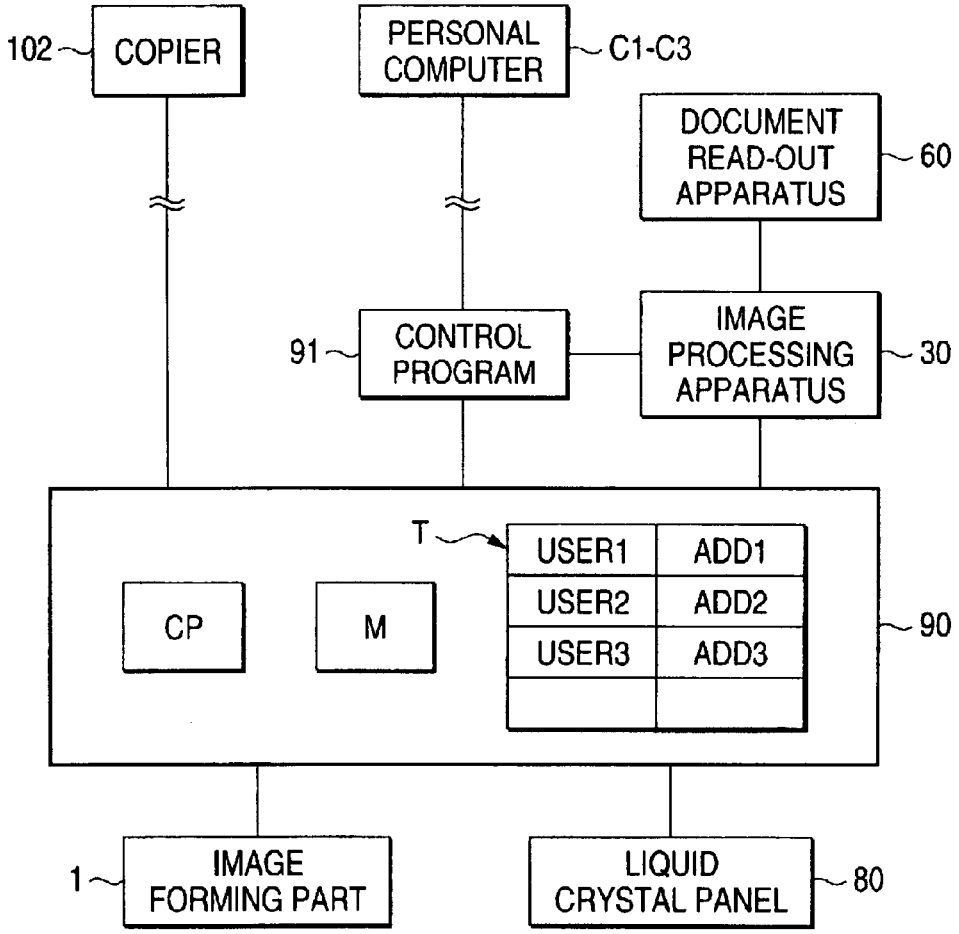
FIG. 5 is a functional block diagram showing a control system of the image formation system according Embodiment 1 of the present invention.

FIG. 5 is a function block diagram showing a control system for controlling a report to the user is described. This control system is formed so as to have control apparatus 90 at the center. Input signals to control apparatus 90 are an installation signal from foaming image forming apparatus 102, a copy instruction from liquid crystal panel 80, a print instruction from personal computers C1 to C3, and the like. Output signals from control apparatus 90 are a display instruction to liquid crystal panel 80, an image formation instruction to image formation part 1, a transmission instruction to communications control apparatus 91, and the like.

Here, the specific configuration of control apparatus 90 has a hardware configuration that includes a central processing unit, a control apparatus, a memory apparatus, an input/output apparatus, a bus for connecting these apparatuses to each other, and the like, and software configuration that includes a control program CP that has been stored in advance in the memory apparatus, a message group M, an address table T, and the like, so that this hardware configuration and this software configuration implement the functions thereof.

Figure 6:
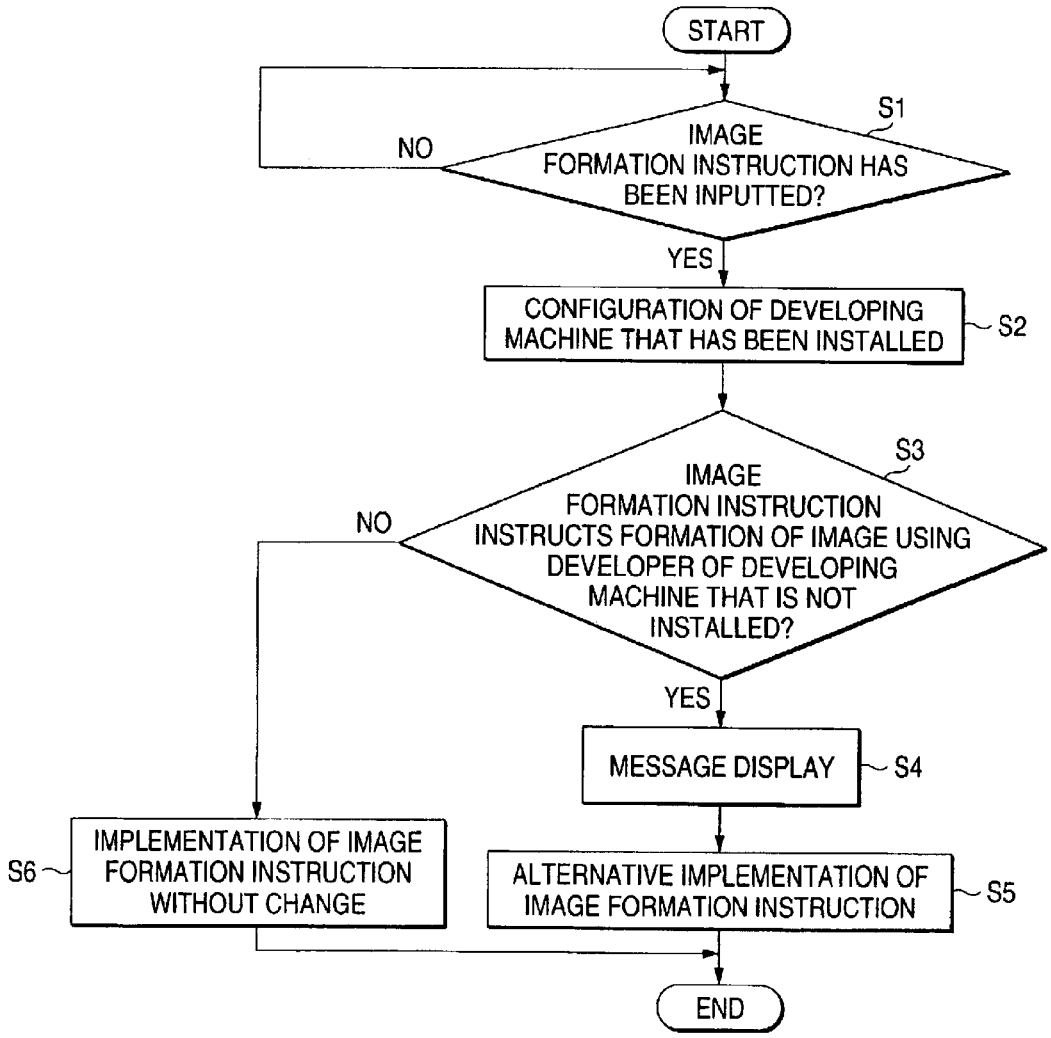
FIG. 6 is a flowchart for explaining the operation of the control system of the image formation system according to Embodiment 1 of the present invention.

FIG. 6 is a flowchart showing an example of the operation of this control system. A report control operation of color copier 100 according to Embodiment 1 is described in the following in accordance with this flowchart. Here, the operation of this control system is not limited to the flowchart of FIG. 6.

First, when an image formation instruction (copy instruction from liquid crystal panel 80 or print instruction from personal computers C1 to C3) is inputted (see S1 of FIG. 6), it is confirmed that the developing machine is installed (S2 of FIG. 6). Specifically, control apparatus 90 transmits a signal to foaming image forming apparatus 102 and it is determined that foaming image forming apparatus 102 is attached when a response signal is received from foaming image forming apparatus 102 and it is determined that foaming image forming apparatus 102 is not attached when a response signal is not received.

Next, the image formation instruction is analyzed and it is determined whether or not the image formation instruction calls for the formation of an image to be obtained by using a developer of a developing machine that is not installed (S3 of FIG. 6). Specifically, when foaming image forming apparatus 102 is attached (see FIG. 4), the image formation instruction is unconditionally carried out without a change (S6 of FIG. 6). When foaming image forming apparatus 102 is not attached (see FIG. 2), control apparatus 90 receives the result of the analysis of the image formation instruction by means of image processing apparatus 30 and it is determined whether or not foaming toner E is to be utilized according to this image formation instruction. Then, in the case where the image formation instruction does not request the utilization of foaming toner E, the image formation instruction is carried out without a change (S6 of FIG. 6). In the case where the image formation instruction requests the utilization of foaming toner E, a message is displayed (S4 of FIG. 6) and this image formation instruction is carried out in an alternative manner (S5 of FIG. 6).

EXAMPLE 1

In the case where, for example in one example, foaming image forming apparatus 102 is not attached and an instruction for forming a portion of the image on recording paper P with foaming toner E is inputted according to a print instruction from personal computer C1, control apparatus 90 carries out the following processing.

Control apparatus 90 first prepares a message for display (S4 of FIG. 6) to the user. An appropriate message m is selected from among message group M according to a control program within control apparatus 90. This message m is formed of the following three messages m1 to m3. First, a message to the effect that this print instruction cannot be carried out without a change, concretely, m1 "foaming toner cannot be utilized," is selected as the first message m1. A task required for carrying out this print instruction without a change, concretely, m2 "Please attach a foaming image forming apparatus in order to obtain an image using a foaming toner," is selected as the second message m2. A processing method of this print instruction, concretely, m3 "black asterisks substitute for the foaming toner portion in the output image at this time," is selected as the third message m3.

Figure 7A:
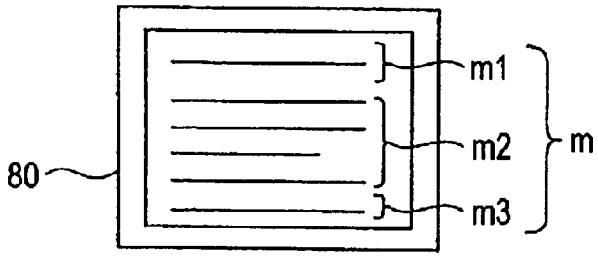
FIGS. 7A to 7C are schematic diagrams showing display examples of the image formation system according to Embodiments 1 through 3 of the present invention.
Figure 7B:
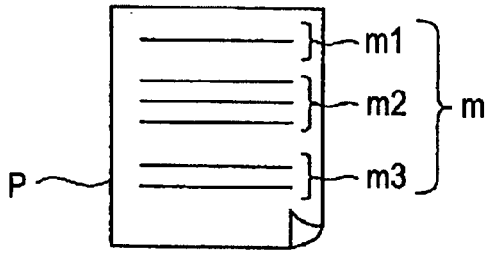
Figure 7C:
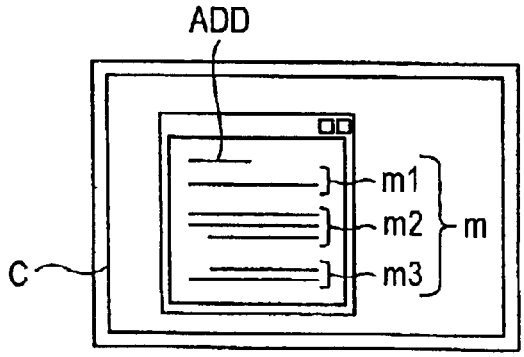

Thus, control apparatus 90, first, displays this message m (=m1+m2+m3) on liquid crystal display panel 80 of copier 100 (see FIG. 7A) and, second, forms the image on recording paper P via image forming unit 1 and outputs the image (see FIG. 7B) and, third, transmits the image by electronic mail to computer C1, which is the origin of the transmission of this print instruction (see FIG. 7C). Here, at the time when electronic mail is transmitted, the address add for transmission is determined based on user information included in the print instruction and in the address table, in which the respective users and e-mail addresses T thereof are stored, which are correlated with each other, in advance.

Figure 8A:
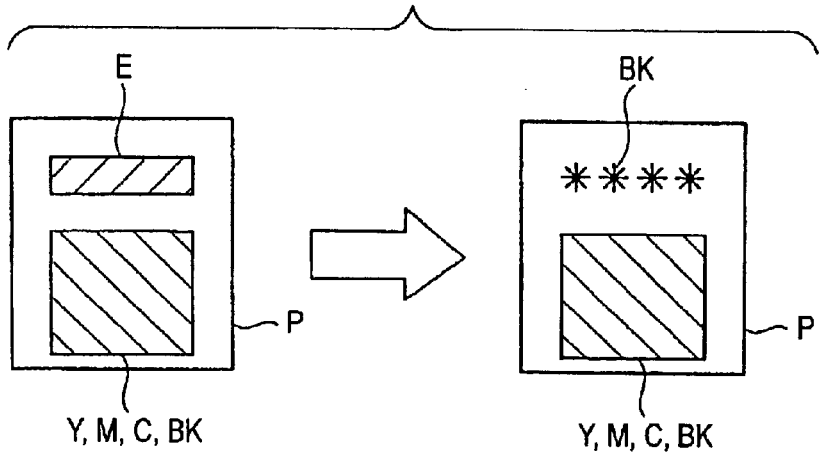
FIGS. 8A and 8B are schematic diagrams showing alternative examples of the image formation system according to Embodiments 1 through 3 of the present invention.

Control apparatus 90 instructs image processing apparatus 30 to convert the print instruction concerning the usage of foaming toner E to the print instruction with asterisks of black toner BK in the print instruction concerning the alternative implementation (S5 of FIG. 6) of the image formation instruction (print instruction). Image processing apparatus 30 converts the gradation data concerning foaming toner E to asterisks, which is outputted to ROS 12(4)= ROS BK and, as a result, an image wherein asterisks of black toner BK substitute for foaming toner E is obtained on recording paper P (see FIG. 8A).

EXAMPLE 2

Figure 8B:
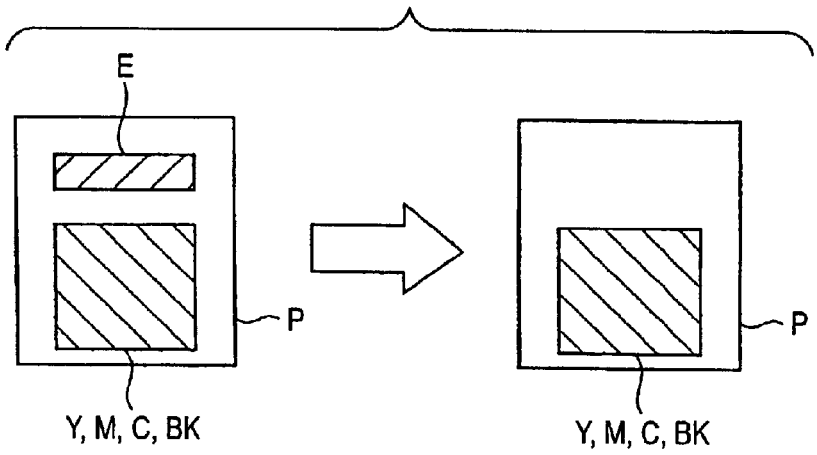

The image of foaming toner E can be erased in another example. When the portion differing from Example 1 is described, m3 "the foam toner portion is erased in the outputted image at this time" is selected as the third message m3 (S4 of FIG. 6) and control apparatus 90 instructs image processing apparatus 30 to erase the print instruction of foaming toner E in the print instruction. Image processing apparatus 30 erases gradation data of foaming toner E and, as a result, an image of which the foaming toner E portion has been erased is obtained on recording paper P (see FIG. 8B).

EXAMPLE 3

The print instruction can be cancelled in another example. When the portion differing from Example 1 is described, m3 "print instruction is cancelled" is selected as the third message m3 (S4 of FIG. 6) and control apparatus 90 instructs image processing apparatus 30 to erase the print instruction. Image processing apparatus 30 erases the print instruction. Accordingly, the print instruction is not carried out in an alternative manner (see S5 of FIG. 6).

EXAMPLE 4

The print instruction can be held in another example. When the portion differing from Example 1 is described, m3 "Print instruction is held. When a foaming image forming unit is installed, the print instruction is carried out." is selected as the third message m3 (S4 of FIG. 6) and control apparatus 90 instructs that the print instruction is to be stored within control apparatus 90 and the print instruction within image processing apparatus 30 is to be erased. Accordingly, the print instruction is not carried out in an alternative manner (see S5 of FIG. 6). After that, when control apparatus 90 detects that foaming image forming apparatus 102 has been attached, control apparatus 90 transmits the print instruction that has been stored to image processing apparatus 30 and the print instruction is carried out without a change (S6 of FIG. 6).

Furthermore, in the modification of this Example 4, m3 "Print instruction is held. When a foaming image forming unit is installed, the print instruction is carried out. Please return this e-mail without a change in order to cancel the hold and to stop printing" is selected as the third message m3 (S4 of FIG. 6). A management number for specifying this print instruction is attached to this e-mail. When the e-mail returned from the user has arrived, control apparatus 90 erases the print instruction that has been held and that is specified by the management number.

EXAMPLE 5

In the case wherein foaming image forming apparatus 102 has been attached and foaming toner E is in short supply within developing machine 73 in another example, the image formation instruction can be carried out in an alternative manner (S5 of FIG. 6). When the portion differing from Example 1 is described, m2 "Please exchange the toner box in the foaming image forming unit" is selected as the second message m2 in this case. Here, the shortage of foaming toner E is detected through communications between foaming image forming apparatus 102 and control apparatus 90.

Here, it is possible to set the processes in these Examples 1 through 5 in advance or for the user to designate the processes in these Examples 1 through 5.

(Embodiment 2)

In Embodiment 1 image formation using foaming toner E is possible by attaching foaming image forming apparatus 102 to color copier 100. On the other hand, in the present embodiment, image formation using foaming toner E is made possible by adding a new foaming image forming unit 1(5) to image formation part 1 of color copier 100 (see FIG. 2). Here, the same numbers are attached to the same parts in the configuration as in color copier 100 according to Embodiment 1 and the descriptions thereof are omitted.

Figure 9A:
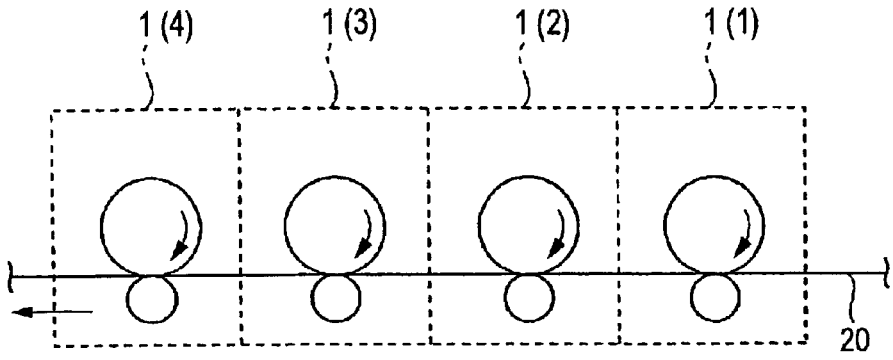
FIGS. 9A and 9B are cross sectional views showing the image formation part of the color copier according to Embodiment 2 of the present invention.
Figure 9B:
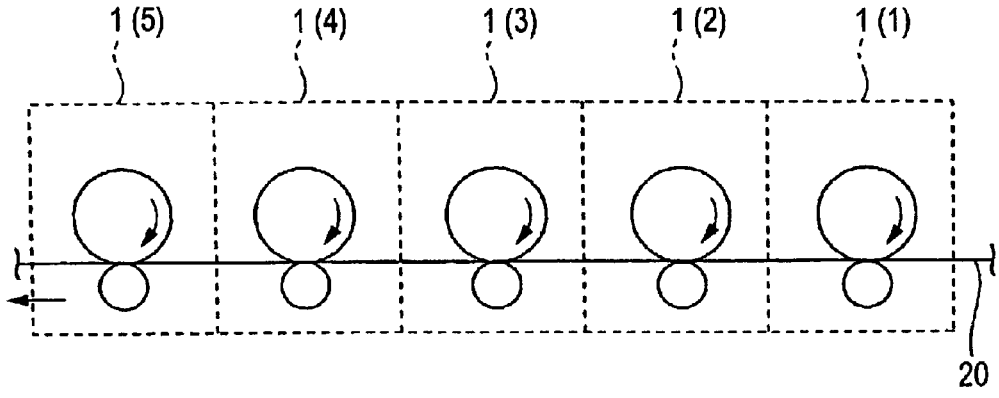

FIG. 9A shows image formation part 1 before foaming image forming unit 1(5) is additionally installed and FIG. 9B shows image formation part 1 after foaming image forming unit 1(5) is additionally installed. This foaming image forming unit 1(5) is formed of a photosensitive drum (image carrier) 10 placed at the center in the same manner as other image forming units 1(1) to 1(4) and an electrification roll 11, a ROS 12, a developing machine (second developing unit) 13, a primary transfer roll 14 and photosensitive body cleaning apparatus 15 are placed around the photosensitive drum (see FIG. 3B). Here, foaming toner E is filled into this developing machine 13(5)=13E. In addition, foaming image forming unit 1(5) is expected to be removed or installed as a unit in many cases and, therefore, an LED array, or the like, which is comparatively resistant to vibration and impact, may be adopted in place of ROS 12.

In addition, it is possible for color copier 100 according to the present embodiment to be equipped with foaming image forming unit 1(5) in the above described manner and a case is considered wherein the foaming image formation is instructed in the condition wherein foaming image forming unit 1(5) is not installed. In order to prepare for such a case, color copier 100 according to the present embodiment is equipped with the following control apparatus (developing unit determination part, announcement part, control part) 90.

Figure 10:
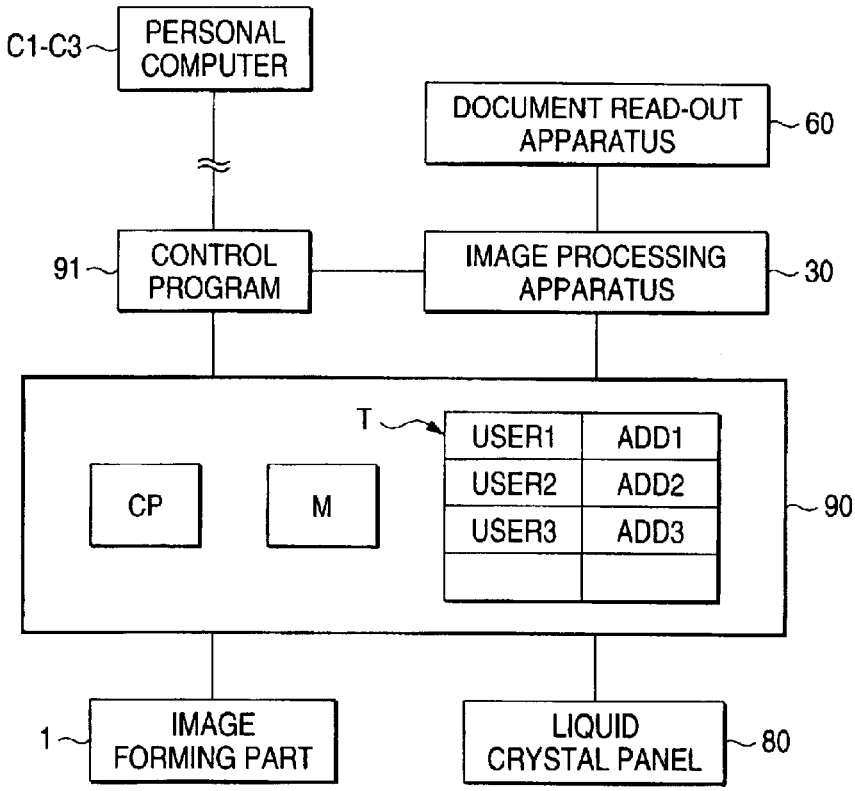
FIG. 10 is a functional block diagram showing the control system of the image formation system according to Embodiments 2 through 3 of the present invention.

FIG. 10 is a function block diagram showing a control system for controlling an announcement to the user is described. This control system is formed so as to have control apparatus 90 at the center. Input signals to control apparatus 90 are an installation signal from image formation part 1, a copy instruction from liquid crystal panel 80, a print instruction from personal computers C1 to C3, and the like. Output signals from control apparatus 90 are a display instruction to liquid crystal panel 80, an image formation instruction to image formation part 1, a transmission instruction to communications control apparatus 91, and the like.

Here, the installation signal from image formation part 1 includes a signal for specifying the type of developer of respective image forming units 1(1) to 1(5). The developers of image forming units 1(1) to 1(5) are a yellow toner, a magenta toner, a cyan toner, a black toner and a foaming toner.

FIG. 6 shows a flowchart for explaining the operation of this control system. In the following, the announcement control operation of color copier 100 according to Embodiment 2 is described in accordance with this flowchart.

First, when an image formation instruction (copy instruction from liquid crystal panel 80 or print instruction from personal computers C1 to C3) is inputted (see S1 of FIG. 6), it is confirmed that the developing machine is installed (S2 of FIG. 6). Concretely, control apparatus 90 accesses a non-volatile memory provided to each of image forming units 1(1) to 1(5) and detects the type of developer of each of image forming units 1(1) to 1(5). Then, when content of any of the non-volatile memories of image forming units 1(1) to 1(5) indicate a "foaming toner", it is determined that foaming image forming unit 1E has been installed and, when the content indicating a "foaming toner" is not accessible, it is determined that foaming image forming unit 1E has not been installed.

Next, the image formation instruction is analyzed and it is determined whether or not the image formation instruction instructs the formation of the image using the developer of the developing machine that has not been installed (S3 of FIG. 6). Concretely, when foaming image forming unit 1E has been installed (see FIG. 9B), the image formation instruction is unconditionally carried out without a change (S6 of FIG. 6). When foaming image forming unit 1E is not installed (see FIG. 9A), control apparatus 90 receives the result of the analysis of the image formation instruction by means of image processing apparatus 30 and it is determined whether or not foaming toner E is to be utilized according to this image formation instruction. Then, in the case where the image formation instruction does not request utilization of foaming toner E, the image formation instruction is carried out without a change (S6 of FIG. 6). In the case where the image formation instruction requests the utilization of foaming toner E, a message is displayed (S4 of FIG. 6) and this image formation instruction is carried out in an alternative manner (S5 of FIG. 6).

Here, a concrete display of the message and the process of the image formation instruction are the same as those in Examples 1 through 5 of Embodiment 1 and, therefore, the descriptions thereof are omitted. In addition, as for the determination of the types of image forming units of 1(1) to 1(5), the type of developer can be determined by providing unique uneven forms to respective image forming units 1(1) to 1(5) and by detecting the forms using a sensor, in addition to the manner using non-volatile memories.

(Embodiment 3)

Image formation using foaming toner E is made possible by adding a new foaming image forming unit 1E to image formation part 1 of color copier 100 (see FIG. 2) in Embodiment 2 while image formation using foaming toner E is made possible by replacing one of respective image forming units 1(1) to 1(4) (=Y to BK) with foaming image forming unit 1E in image formation part 1 of color copier 100 according to the present embodiment. Here, the same numbers are attached to the same parts of the configuration as in color copier 100 according to Embodiments 1 and 2 and the descriptions thereof are omitted.

TABLE 1

| Case | Print instruction | 1(4) | 1(3) | 1(2) | 1(1) |
|---|---|---|---|---|---|
| 1 | Black | K | C | Y | M |
| 2 | Black + foaming toner | K | C | Y | M |
| 3 | Full color | K | C | Y | M |
| 4 | Full color + foaming toner | E | C | M | Y |
| 5 | Black | E | C | M | Y |
| 6 | Black + foaming toner | E | C | M | Y |
| 7 | Full color | E | C | M | Y |
| 8 | Full color + foaming toner | E | C | M | Y |
| 9 | Black | K | E | M | Y |
| 10 | Black + foaming toner | K | E | M | Y |
| 11 | Full color | K | E | M | Y |
| 12 | Full color + foaming toner | K | E | M | Y |
| 13 | Black | K | C | E | Y |

TABLE 1-continued

| Case | Print instruction | 1(4) | 1(3) | 1(2) | 1(1) |
|---|---|---|---|---|---|
| 14 | Black + foaming toner | K | C | E | Y |
| 15 | Full color | K | C | E | Y |
| 16 | Full color + foaming toner | K | C | E | Y |
| 17 | Black | K | C | M | E |
| 18 | Black + foaming toner | K | C | M | E |
| 19 | Full color | K | C | M | E |
| 20 | Full color + foaming toner | K | C | M | E |

Table 1 shows each case of color copier 100 according to the present example. Cases 1 to 4 indicate color copier 100 in the initial condition wherein first image forming unit 1(1) is image forming unit 1Y having a yellow toner, second image forming unit 1(1) is image forming unit 1M having a magenta toner, third image forming unit 1(3) is image forming unit 1C having a cyan toner and fourth image forming unit 1(4) is image forming unit 1BK having a black toner (see FIG. 3A). On the other hand, cases 5 to 20 indicate the conditions wherein one of the image forming units in the initial condition is replaced with foaming image forming unit 1E having foaming toner E wherein cases 5 to 8 indicate the cases wherein 1BK is replaced with 1E in fourth image forming unit 1(4), cases 9 to 12 indicate the cases wherein 1C is replaced with 1E in third image forming unit 1(3), cases 13 to 16 indicate the cases wherein 1M is replaced with 1E in second image forming unit 1(2) and cases 17 to 20 indicate the cases wherein 1Y is replaced with 1E in first image forming unit 1(1), respectively.

First, in cases 1, 3, 8, 9, 10, 13, 14, 17 and 18, necessary image forming units are provided and, therefore, the print instruction is carried out without a change (S6 of FIG. 6).

In case 2, the necessary image forming unit 1E is not provided and, therefore, a mode wherein whichever of 1C, 1M or 1Y that is replaced by 1E is displayed and the print instruction is held until replacement is carried out as well as a mode wherein an alternative printing with symbols such as asterisks is carried out for the print out portion using a foaming toner and a message is displayed that an alternative printing is carried out for the requested print instruction can be selectively implemented and the user can, in advance, select either of these modes.

In case 4, the necessary image forming unit 1E is not provided and, therefore, display is carried out to the effect that 1K and 1E are exchanged and a mode wherein the print instruction is held until the exchange is carried out as well as a mode wherein an alternative printing is carried out with symbols such as asterisks and a message is displayed that an alternative printing has been carried out for the print out portion using foaming toner can be selectively implemented and the user can, in advance, select either of these embodiments.

In cases 5 and 7, a mode wherein a display is carried out to the effect that 1E is removed and 1K is installed and the print instruction is held until the exchange is carried out as well as a mode wherein printing is carried out using 1C, 1M and 1Y can be selectively implemented and the user can, in advance, select either of these embodiments.

In case 6, the necessary image forming unit 1K is not provided and, therefore, an embodiment wherein a display is carried out to the effect that 1E is removed, 1K is installed and the removed 1E is replaced with any of 1C, 1M or 1Y and the print instruction is held until the exchange is carried out as well as an embodiment where in printing is carried out with process black using 1C, 1M and 1Y can be selectively implemented and the user can, in advance, select either of these embodiments.

In cases 11, 15 and 19, display is carried out to the effect that 1E and 1K, which have been installed, are removed and 1E is replaced with 1K and, furthermore, all of 1C, 1M and 1Y are installed and the print instruction is held until being carried out.

In cases 12, 16 and 20, display is carried out to the effect that 1E and 1K, which have been installed, are removed and 1E is replaced with 1K and, furthermore, all of 1C, 1M and 1Y are installed and the print instruction is held until being carried out.

Here, a concrete display of messages and the process of the image formation instruction are the same as those in Examples 1 through 5 of Embodiment 1 and, therefore, the descriptions thereof are omitted.

EXAMPLE 6

In a case such as case 5, for example, wherein image forming unit 1K for black is not installed and an instruction for forming the image on recording paper P with black toner BK is inputted by means of a print instruction from personal computer C1 in one example, control apparatus 90 carries out the following processing.

Control apparatus 90 first prepares a message for display (S4 of FIG. 6) to the user. An appropriate message m is selected from among message group M according to a control program within control apparatus 90. This message m is formed of the following three messages m1 to m3. First, a message to the effect that this print instruction cannot be carried out without a change, concretely, m1 "foaming toner cannot be utilized," is selected as the first message m1. A task required for carrying out this print instruction without a change, concretely, m2 "please attach another image forming unit in place of image forming unit 1K in order to obtain an image using a black toner," is selected as the second message m2. A processing method of this print instruction, concretely, m3 "process black of yellow, magenta and cyan substitutes for the black toner portion in the image output at this time," is selected as the third message m3.

Thus, control apparatus 90, first, displays this message m (=m1+m2+m3) on liquid crystal display panel 80 of copier 100 (see FIG. 7A) and, second, forms the image on recording paper P via image forming unit 1 and outputs the image (see FIG. 7B) and, third, transmits the image by electronic mail to computer C1, which is the origin of the transmission of this print instruction (see FIG. 7C).

Figure 11:
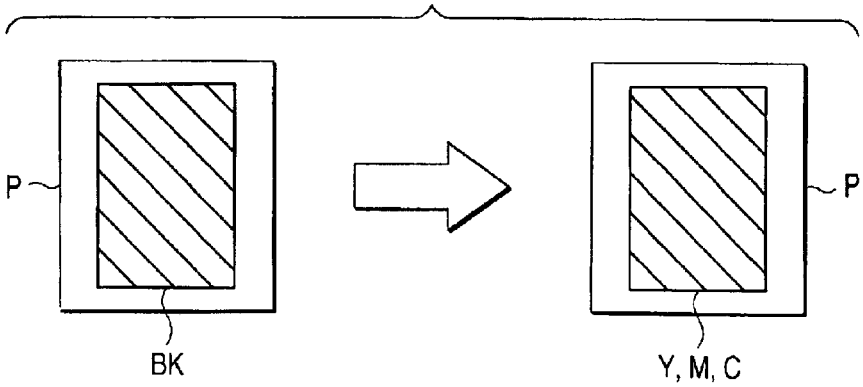
FIG. 11 is a schematic diagram showing an alternative example of the image formation system according to Example 6 of Embodiment 3 of the present invention.

Control apparatus 90 instructs image processing apparatus 30 to convert the print instruction concerning the usage of black toner BK to the print instruction with the respective toners of yellow, magenta and cyan in the print instruction concerning the alternative implementation (S5 of FIG. 6) of the image formation instruction (print instruction) Image processing apparatus 30 converts the gradation data concerning black toner BK to gradation data of the respective toners of yellow, magenta and cyan, which is outputted to ROS 12(1) to 12(3)=and, as a result, an image (process black image) wherein the respective toners of yellow, magenta and cyan substitute for the black toner BK portion is obtained on recording paper P (see FIG. 11).

Here, in cases 10, 14 and 18, the following control is carried out in order for foaming toner E to form a lower layer below black toner BK on recording paper P.

First, an image obtained by using black toner BK is primarily transferred onto intermediate transfer belt 20 by means of image forming unit 1K. Then, intermediate transfer belt 20 is rotated approximately one revolution in the condition wherein secondary transfer roll 24 and belt cleaning apparatus 27 are separated from belt 20 and, after that, the image obtained by using foaming toner E is primarily transferred over this image obtained by using black toner BK. After that, secondary transfer roll 24 and belt cleaning apparatus 27 are brought in contact with belt 20 so that the toner images thereon are secondarily transferred on to recording paper P at secondary transfer position T2. Thus, foaming toner E, which is subsequently primarily transferred, forms the lowest layer on recording paper P.

(Concerning Foaming Toner)

In the following, foaming toner E utilized in these Embodiments 1 through 3 is described in detail. Foaming toner E is a toner for image formation that includes at least a bonding resin and a foaming agent and the configurations in the embodiments utilize toners wherein a foaming agent is not substantially exposed from the toner surface.

The foaming agent is not specifically limited and any type can be utilized as long as it expands in volume when heated. It may be solid or maybe liquidate room temperature. In addition, the foaming agent is not limited to a material made of a single substance but, rather, may be a material made of a plurality of substances or maybe a functional material such as microcapsule particles. The preferable range of the foaming temperature of the foaming agent varies depending on which type of apparatus is utilized for the formation of a three-dimensional image and, in the case wherein a three-dimensional image is formed using a conventional printer or copier as shown in FIGS. 1 and 2, it is preferable for the foaming temperature to be at, or lower than, the temperature for heated fixing.

A foaming agent of which the main material is a substance that generates a gas through thermal decomposition can be used as the above described foaming agent and, concretely, bicarbonates such as sodium bicarbonate that generate carbonic acid gas through thermal decomposition, a mixture of $NaNO_2$ and $NH_4Cl$ as well as azo compounds such as azobisisobutyronitrile or diazoaminobenzene that generate a nitride gas, peroxides that generate oxygen, and the like, can be cited.

As for another embodiment of the foaming agent, a foaming agent of microcapsule particles (hereinafter referred to, in some cases, as "microcapsule-type foaming agent") that encapsulate a low boiling point substance (may be in a liquid state or in a solid state at room temperature) that evaporates at a low temperature can be cited. A microcapsule-type foaming agent is preferable because of its high foaming properties. In the case where a toner for image formation of the present embodiments is utilized in a conventional printer or copier, it is necessary for the low boiling point substance encapsulated in the microcapsules to evaporate at a temperature that is, at least, lower than the temperature for heated fixing and, concretely, is a substance that evaporates at a temperature no higher than 100° C., preferably, no higher than 50° C. and, more preferably, no higher than 25° C. Here, the thermal response properties of a microcapsule-type foaming agent depend on the temperature wherein the wall material is softened in addition to the boiling point of the low boiling point substance, which is the core material, and, therefore, the preferable range of the boiling point of the low boiling point substance is not limited to the above described range. Neopentane, neohexane, isopentane, isobutylene, isobutane, and the like, can be cited as examples of low boiling point substances. In particular, isobutane, which is stable against the material of the walls of the microcapsules and which has a high coefficient of thermal expansion, is preferable.

It is preferable for the material of the walls of the microcapsules to be a material having resistance to a variety of solvents used in the manufacturing process of toners and that are impermeable to the gas resulting from the evaporation of the low boiling point substance encapsulated in the microcapsules. In addition, in the case where a toner for image formation of the present embodiments is utilized in a conventional printer or copier, it is necessary for the material of the walls to be softened and to expand at a temperature lower than the temperature for heated fixing. A wide variety of conventionally used wall materials can be utilized as the material for the walls of the microcapsules. For example, monopolymers such as polyvinylchloride, polyvinyl acetate, polystyrene, polyacrylonitrile, polybutadiene, polyacrylic ester, and the like, as well as copolymers of these, are preferably used. In particular, a copolymer of vinylidene chloride and acrylonitrile is preferable from the point of view that the adhesion with the bonding resin is high and that resistance to solvents is high.

The preferable range of the content of the foaming agent in a toner of the present embodiments varies depending on the type of foaming agent and is, in general, from 5 wt. % to 50 wt. %, preferably, 10 wt. % to 40 wt. %. In the case where the content of the foaming agent is less than 5 wt. %, the thermal expansion of the toner becomes insufficient for practical use in some cases while, in the case where the content exceeds 50 wt. %, the ratio of the bonding resin in the toner becomes relatively low and a problem arises in some cases such that sufficient fixing cannot be obtained.

The bonding resin of a toner for three-dimensional image formation of this embodiment is not particularly limited and resins generally used as a resin for a toner can be utilized. Concretely, polyester resin, styrene resin, acryl resin, styrene acryl resin, silicone resin, epoxy resin, diene-based resin, phenol resin, ethylene vinyl acetate resin, and the like, are cited and polyester resin is preferable.

As for the bonding resin of this embodiment, two, or more, types of the above described polyester resins may be combined or another type of resin may be additionally combined. As for other types of resins, styrene resin, acryl resin, styrene acryl resin, silicone resin, epoxy resin, diene-based resin, phenol resin, terpene resin, coumarin resin, amide resin, amide imide resin, butyral resin, urethane resin, ethylene vinyl acetone resin, polypropylene resin, polyethylene resin, natural wax resins such as carnauba wax are cited. In the present embodiment it is preferable to use polyester resin as the main component and to add an amount of 0 wt. % to 30 wt. % of another resin to the toner. In addition, in the case wherein a forming agent is dispersed in a monomer of the bonding resin and a toner is fabricated by polymerizing these by suspension, monomers that make possible suspension polymerization in the above described bonding resin can be utilized.

When a toner particle of foaming toner E is sliced and the slice is observed with a microscope, the particle is formed of, at least, the bonding resin and foaming particles, wherein foaming particles are encapsulated at the core of the toner without loss of foaming properties. Since the toner particles of foaming toner E have a structure wherein the foaming agent is not substantially exposed from the surface, the toner has a high thermal expansion and maintains a high adhesion to the recording medium and a high electrification stability.

Here, the expression "is not substantially exposed from the surface," indicates that the foaming agent is not at all exposed from the surface in at least 80% of toner particles based on, for example, the observation of photographs of 50 toner particles taken by electronic microscopes. In addition, when the foaming agent is uniformly dispersed in the toner in the form of particles, the adhesion to the recording medium of the toner and the electrification stability can be increased, which is preferable.

Though a coloring agent is not included in foaming toner E of Embodiment 1, a coloring agent may be included so that the toner is colored and is made visible. As for the dispersed coloring agent, publicly known organic or inorganic pigments, dyes and oil soluble dyes can be utilized. The appropriate ratio of these coloring agents depends on the diameters of the toner particles and on the amount developed and, in general, approximately one to 100 weight parts relative to 100 weight parts of the toner is appropriate.

In addition, a magnetic substance may be included in foaming toner E in order to give the toner magnetic properties. As for the types of magnetic substances, publicly known magnetic substances can be appropriately utilized. Furthermore, a mold release agent may be included in foaming toner E if desired. An offset phenomenon, or the like, at the time of contact fixing can be prevented by including a mold release agent, which is preferable. Here, an electrification control agent may be added to foaming toner E if desired. Moreover, a publicly known external additive may be added to foaming toner E in order to control the fluidity or the developing properties.

As for the manufacturing method of foaming toner E, the toner is fabricated by means of a process that includes the step of fabrication of particles of an oil phase by dispersing in suspension the oil phase wherein at least a bonding resin and a foaming agent are solved and/or dispersed in a solvent in a water phase and the step of removing the solvent from the above described particles. In addition, foaming toner E may be fabricated by means of a process that includes the step of suspension polymerization in a water phase of a monomer for the bonding resin wherein, at least, a foaming agent is solved or dispersed. Foaming toner E contains 75 wt. % of a binder polymer as the bonding resin and only 25 wt. % of Expancel 461 as the foaming agent. The volume mean diameter of the particles of this foaming toner E is approximately 30 $\mu$m.

As for the developing system wherein foaming toner E is utilized, though a foaming toner is used in any of a two component developing system, in a non-magnetic one component developing system or in a magnetic one developing system, in the present embodiments a two component developing system is adopted in order to form an image. As for the toner composition, though a wax that makes possible oilless thermal fixing may be included, or may not be included, in either a foaming toner or in anon-foaming full color toner, in the present embodiments toners that do not include the wax are adopted for either the foaming toners or the non-foaming color toners and an image is formed in a soft roll fixing apparatus to which an oil system is attached.

Furthermore, though the above embodiments are described based on examples that have been applied to image forming apparatuses of electronic photography systems, the present invention is applicable to an image forming apparatus of, for example, a thermal ink jet system or of a thermal transfer system. In addition, the developing material is not limited to toners but, rather, liquid ink, solid ink or a donor sheet may be included as developing materials.

As described above in detail, an image forming apparatus can be provided according to the present invention, wherein in the case where the user instructs in a mistaken manner the formation of an image to be obtained by using a developing unit that is not installed, the user can be made to recognize that such a developing unit is not installed to the image forming apparatus where in developing units, or the like, can be installed (in an exchangeable manner or in an additive manner).

The foregoing description of the preferred embodiments of the invention has been presented for purposes of illustration and description. It is not intended to be exhaustive or to limit the invention to the precise form disclosed, and modifications and variations are possible in light of the above teachings or maybe acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image formation system, comprising:

a first image formation section adapted to form an image using at least one type of first image formation material to form an image within a color range produced with at least one of three primary colors on a sheet of paper;

a second image formation section being selectively added to the first image formation section, and adapted to form an image using a second image formation material to form an image that cannot be produced with the first image formation material on a sheet of paper; and an announcing section adapted to announce, when the second image formation section is not added and image formation using the second image formation material is requested, that the request cannot be responded to.

2. The image formation system according to claim 1, further comprising:

a control section adapted to control, when the second image formation section is not added and image formation using the second image formation material is request, so that image formation in response to the request is held and, then, the image formation in response to the request is implemented after the second image formation section is added.

3. The image formation system according to claim 1, further comprising:

a control section adapted to control, when the second image formation section is not added, when image formation using the second image formation material is requested, so that image formation in response to the request is held, wherein the announcing section further announces a treatment method for resolving the held condition.

4. The image formation system according to claim 1, wherein the announcing section announces that the request cannot be responded to by at least one of image formation on a sheet of paper, announcing by electronic mail, display on a display panel and announcing by speech sound.

5. The image formation system according to claim 1, wherein the second image formation material comprises an image formation material that is fixed on a sheet of paper in a raised manner and the first and second image formation sections form an image so that the first image formation material is located over the second image formation material on a sheet of paper.

6. The image formation system according to claim 1, wherein the first image formation material includes a black coloring agent, a cyan coloring agent, a yellow coloring agent and a magenta coloring agent, and the second image formation material is at least one of a colorless agent and a coloring agent for a color other than black, cyan, yellow and magenta.

7. The image formation system according to claim 6, wherein the coloring agent is a metallic coloring agent.

8. The image formation system according to claim 6, wherein the colorless agent is a foaming agent.

9. An image formation system, comprising:

a first image formation section adapted to form an image using at least one type of first image formation material to form an image within a color range produced with at least one of three primary colors on a sheet of paper;

a second image formation section, which replaces at least a portion of the first image formation section, for forming an image using a second image formation material to form an image that cannot be represented with the three primary colors on a sheet of paper in place of image formation using at least one of the first image formation material; and a first announcing section adapted to announce, when no portion of the first image formation section is replaced with the second image formation section, and image formation using the second image formation material is requested, that the request cannot be responded to.

10. The image formation system according to claim 9, further comprising a second announcing section adapted to announce, when at least one portion of the first image formation section is replaced with the second image formation section, and an image formation request that includes a request for forming an image using the first image formation material is made, that this image formation request cannot be responded to.

11. The image formation system according to claim 9, wherein the first announcing section announces that the request cannot be responded to by at least one of image formation on a sheet of paper, announcing by electronic mail, display on a display panel and announcing by speech sound.

12. The image formation system according to claim 9, wherein the second image formation material comprises an image formation material that is fixed on a sheet of paper in a raised manner and the first and second image formation sections form an image so that the first image formation material is located over the second image formation material on a sheet of paper.

13. The image formation system according to claim 9, wherein the second image formation material comprises an image formation material for producing at least one of a metallic color and a fluorescent color and the first and second image formation sections form an image so that second image formation material is placed over the first image formation material on a sheet of paper.

14. The image formation system according to claim 9, wherein the first image formation section forms an image using image formation materials of yellow, magenta, cyan and black as the first image formation material, the second image formation section forms an image using the second image formation material in place of the image formation using the black image formation material, and when a request for forming an image using the second image formation material includes a portion of image formation using black, an image is formed using the image formation materials of yellow, magenta and cyan in place of the black image formation material.

15. The image formation system according to claim 9, wherein the first image formation material includes a black coloring agent, a cyan coloring agent, a yellow coloring agent and a magenta coloring agent, and the second image formation material is at least one of a colorless agent and a coloring agent for a color other than black, cyan, yellow and magenta.

16. The image formation system according to claim 15, wherein the coloring agent is a metallic coloring agent.

17. The image formation system according to claim 15, wherein the colorless agent is a foaming agent.

18. An image formation system, comprising:

a first image formation section adapted to form an image using first image formation material to form an image within a color range produced with at least one of three primary colors for forming an image, in accordance with the request, on a sheet of paper;

a second image formation section being selectively added to the first image formation section, for forming an image using a second image formation material to form an image that cannot be produced with the first image formation material on a sheet of paper; and a control section adapted to control, when the second image formation section is not added, and image formation using the second image formation material is requested, so that image formation in accordance with the request is not carried out.

19. The image formation system according to claim 18, wherein the control section controls so that an alternative image is formed using the first image formation material in a portion where an image is to be formed using the second image formation material in place of the image formation in accordance with the request.

20. The image formation system according to claim 18, wherein the first image formation material includes a black coloring agent, a cyan coloring agent, a yellow coloring agent and a magenta coloring agent, and the second image formation material is at least one of a colorless agent and a coloring agent for a color other than black, cyan, yellow and magenta.

21. The image formation system according to claim 20, wherein the coloring agent is a metallic coloring agent.

22. The image formation system according to claim 20, wherein the colorless agent is a foaming agent.

23. An image formation system, comprising:

a first image formation section adapted to form an image using at least on type of first image formation material to form an image within a color range produced with at least one of three primary colors on a sheet of paper;

a second image formation section being selectively added to the first image formation section, for forming an image using a second image formation material to form an image that cannot be produced with the first image formation material on a sheet of paper; and a control section adapted to control, when the second image formation section is not added, and image formation using the second image formation material is requested, so that image formation in response to the request is held.

24. The image formation system according to claim 23, wherein the control section releases the hold on the condition where the second image formation material is added.

25. The image formation system according to claim 23, wherein the first image formation material includes a black coloring agent, a cyan coloring agent, a yellow coloring agent and a magenta coloring agent, and the second image formation material is at least one of a colorless agent and a coloring agent for a color other than black, cyan, yellow and magenta.

26. The image formation system according to claim 25, wherein the coloring agent is a metallic coloring agent.

27. The image formation system according to claim 25, wherein the colorless agent is a foaming agent.

28. An image formation system, comprising:

a first image formation section adapted to form an image using a first image formation material to form an image within a color range produced with at least one of three primary colors on a sheet of paper for forming an image in accordance with the request;

a second image formation section, equipped with a second image formation material for forming an image that cannot be represented with the three primary colors on a sheet of paper in place of at least one of the image formation materials of the first image formation section, for forming an image using the second image formation material; and a control section adapted to control, when the second image formation material is not provided in place of the first image formation material and when a request for forming an image using the second image formation material is made, so that image formation in accordance with this request is not carried out.

29. The image formation system according to claim 28, wherein the control section controls so that an alternative image is formed using the first image formation material in a portion on which an image is to be formed using the second image formation material in place of the image formation in accordance with the request.

30. The image formation system according to claim 28, wherein the first image formation material includes a black coloring agent, a cyan coloring agent, a yellow coloring agent and a magenta coloring agent, and the second image formation material is at least one of a colorless agent and a coloring agent for a color other than black, cyan, yellow and magenta.

31. The image formation system according to claim 30, wherein the coloring agent is a metallic coloring agent.

32. The image formation system according to claim 30, wherein the colorless agent is a foaming agent.

33. An image formation system, comprising:

a first image formation section for forming an image using a first image formation material to form an image within a color range produce with at least one of three primary colors on a sheet of paper;

a second image formation section, which replaces at least a portion of the first image formation section, for forming an image using the second image formation material to form an image that cannot be represented with the three primary colors on a sheet of paper in place of the image formation using at least one of the first image formation material; and a control section adapted to control, when no portion of the first image formation section is replaced with the second image formation section, and image formation using the second image formation material is requested, so that image formation in response to the request is held.

34. The image formation system according claim 33, wherein the control section releases the hold on the condition where the second image formation material is provided in place of the first image formation material.

35. The image formation system according to claim 33, wherein the first image formation material includes a black coloring agent, a cyan coloring agent, a yellow coloring agent and a magenta coloring agent, and the second image formation material is at least one of a colorless agent and a coloring agent for a color other than black, cyan, yellow and magenta.

36. The image formation system according to claim 35, wherein the coloring agent is a metallic coloring agent.

37. The image formation system according to claim 35, wherein the colorless agent is a foaming agent.

38. An image formation system, comprising:

a first image formation section adapted to form an image using at least one type of a first image formation material to form an image within a color range produced with at least one of three primary colors on a sheet of paper;

a second image formation section, which replaces at least a portion of the first image formation section, for forming an image using a second image formation material to form an image that cannot be represented with the three primary colors on a sheet of paper in place of the image formation using at least one of the first image formation material; and a determination section adapted to compare the types of image formation materials that have been provided and the types requested by the image formation request and for determining whether the requested image formation can be carried out.

39. The image formation system according to claim 38, wherein the first image formation material includes a black coloring agent, a cyan coloring agent, a yellow coloring agent and a magenta coloring agent, and the second image formation material is at least one of a colorless agent and a coloring agent for a color other than black, cyan, yellow and magenta.

40. The image formation system according to claim 39, wherein the coloring agent is a metallic coloring agent.

41. The image formation system according to claim 39, wherein the colorless agent is a foaming agent.

* * * * *